US005815853A

United States Patent [19]

Chase

[11] Patent Number: 5,815,853

[45] Date of Patent: Oct. 6, 1998

[54] REINFORCED SWIMMING POOL

[75] Inventor: Ascher Chase, Virginia Beach, Va.

[73] Assignee: General Foam Plastics, Norfolk, Va.

[21] Appl. No.: 222,584

[22] Filed: Apr. 4, 1994

[51] Int. Cl.[6] ..... E04H 4/00

[52] U.S. Cl. ..... 4/506

[58] Field of Search ..... 4/496, 506, 513

[56] References Cited

U.S. PATENT DOCUMENTS

| | | | |
|---|---|---|---|
| 2,839,762 | 6/1958 | Nomura | 4/506 X |
| 3,562,822 | 2/1971 | Wall | 4/506 X |
| 3,832,814 | 9/1974 | Teschner . | |
| 3,899,622 | 8/1975 | Geiger . | |
| 4,125,983 | 11/1978 | Jarrell . | |
| 4,177,614 | 12/1979 | Arp . | |
| 4,223,498 | 9/1980 | Ventrice | 4/506 X |
| 4,356,933 | 11/1982 | Connolly . | |
| 4,405,341 | 9/1983 | Jaschek et al. . | |
| 4,574,106 | 3/1986 | Rogers . | |
| 5,054,135 | 10/1991 | Dallaire et al. . | |
| 5,161,264 | 11/1992 | Dugas | 4/506 |

FOREIGN PATENT DOCUMENTS

| | | | |
|---|---|---|---|
| 2145560 | 4/1973 | Germany | 4/506 |
| 1049272 | 11/1966 | United Kingdom | 4/506 |
| 1261770 | 1/1972 | United Kingdom | 4/506 |

*Primary Examiner*—Charles E. Phillips
*Attorney, Agent, or Firm*—Schweitzer Cornman Gross & Bondell LLP

[57] ABSTRACT

An above-the-ground pool construction having a catastrophic failure-proof wall of comparatively low weight which is fabricated from a laminate of polypropylene and a woven polypropylene mesh reinforcement. The new wall is stronger and safer than existing walls; it is lighter weight; and it provides ease of pool wall decoration through the use of woven designs in the reinforcing mesh or by printing the mesh before it is laminated.

5 Claims, 2 Drawing Sheets

FIG. 3
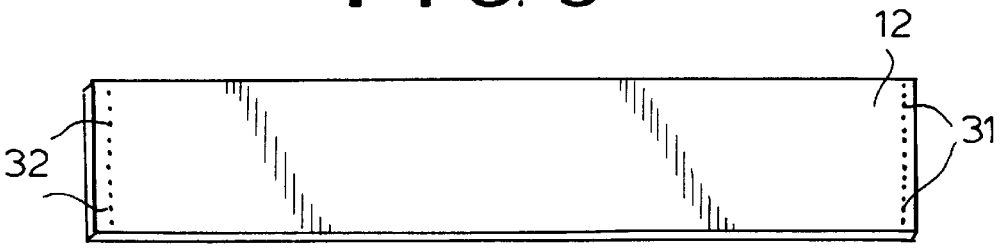
FIG. 4
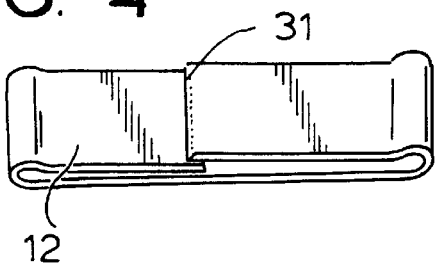
FIG. 5
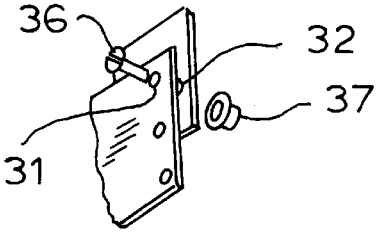
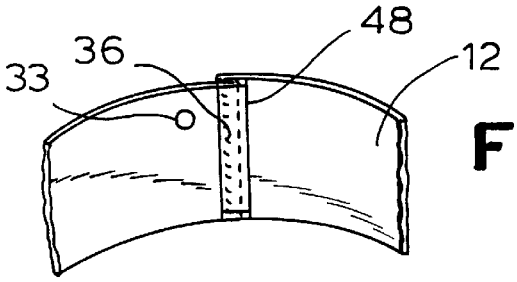
FIG. 6
FIG. 7
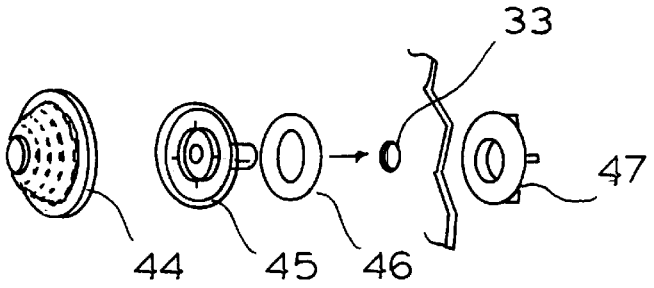

REINFORCED SWIMMING POOL

BACKGROUND OF THE INVENTION

This invention relates generally to an improved, light-weight, above-the-ground swimming pool construction which is catastrophic failure-proof owing to the use of a new and improved novel plastic wall material. The new pool requires no internal reinforcement or external support of any kind against the outward pressure of the water contained therein.

Above-ground pools are typically constructed of steel, aluminum or molded thermoplastic material and utilize the same components regardless of the materials. Ordinarily, the components making up the framework for an above-ground pool include rail sections connected to separate base plates; vertical uprights or posts set on the base plates and coping or ledge sections normally connected together over the posts; and, cap members to cover the joints over the posts. A flexible side retaining wall of sheet metal or relatively thick plastic is provided and is held in the rail and by the coping and a liner, normally of flexible vinyl plastic, is supported on the upper edge of the retaining wall. Examples of such prior art pool frames can be found in U.S. Pat. Nos. 3,268,917 Diamond et al 1965; 3,233,251 Barrera 1966; 3,874,132 Mendelow et al 1975; 4,062,158 Kaufmann et al 1977; 4,847,926 Laputka 1989; and 5,054,134 Dallaire et al 1991.

Assembly and joining of the panels is time-consuming, requires tools often not available in households, an important consideration in the erection of small backyard pools. More importantly, earlier pool walls in this type structure have sometimes failed catastrophically and flooded the surrounding area.

SUMMARY OF THE INVENTION

A main object of the invention is to provide an improved, light-weight, above-the-ground swimming pool construction which is free of the above-outlined deficiencies of the prior art, is comparatively easy to assemble and to erect, and is catastrophic failure-proof.

A related object of the invention is to provide a simple, very light, yet solid and long lasting circular swimming pool wall element which can be manufactured at a lower cost than prior art elements fabricated for this purpose. Another important object of this invention is to provide a light-weight, do-it-yourself kit containing the constituent parts of the present pool so as to enable its facile erection by unskilled persons in their backyards and the like.

The objects of the invention may be achieved through the use of a new and improved pool wall material comprising a laminate of woven polypropylene mesh fabric and polypropylene sheets. The new wall material provides a stronger and safer wall than has heretofore been available in this type structure. Advantageously the new wall may be decorated by either printing a design on the mesh before lamination or by weaving a chosen design into the mesh during its fabrication. Existing plastic walls, while fundamentally much safer than metal walls, are relatively heavy and have a tendency (as does metal) to fail catastrophically and to dump water into the surrounding environment like a dam breaking. In accordance with the principles of the invention, the new material, should it fail, will not "burst"; rather, a few strands of fiber mesh may break permitting some water to slowly leak from the pool. In addition, use of the new wall material significantly reduces the weight of an otherwise all solid plastic wall; it reduces manufacturing costs; it reduces shipping costs, and provides many useful options to decorate pool walls through the use of colorful woven mesh designs.

Other advantages to be derived from the practice of this invention will appear from the following description thereof taken in conjunction with the accompanying drawings.

BRIEF DESCRIPTION OF THE DRAWING

FIG. 3 is a perspective view of the flat pool wall element before assembly and erection;

FIG. 4 is a perspective view of the wall assembly;

FIG. 5 is an enlarged fragmentary exploded view of the overlapped bolted ends of the pool wall assembly;

FIG. 6 is a fragmentary view of the pool assembly with adhesive tape covering the bolts; and FIG. 7 is an exploded view of pool fitting hardware.

DETAILED DESCRIPTION OF THE INVENTION

Figure 1:
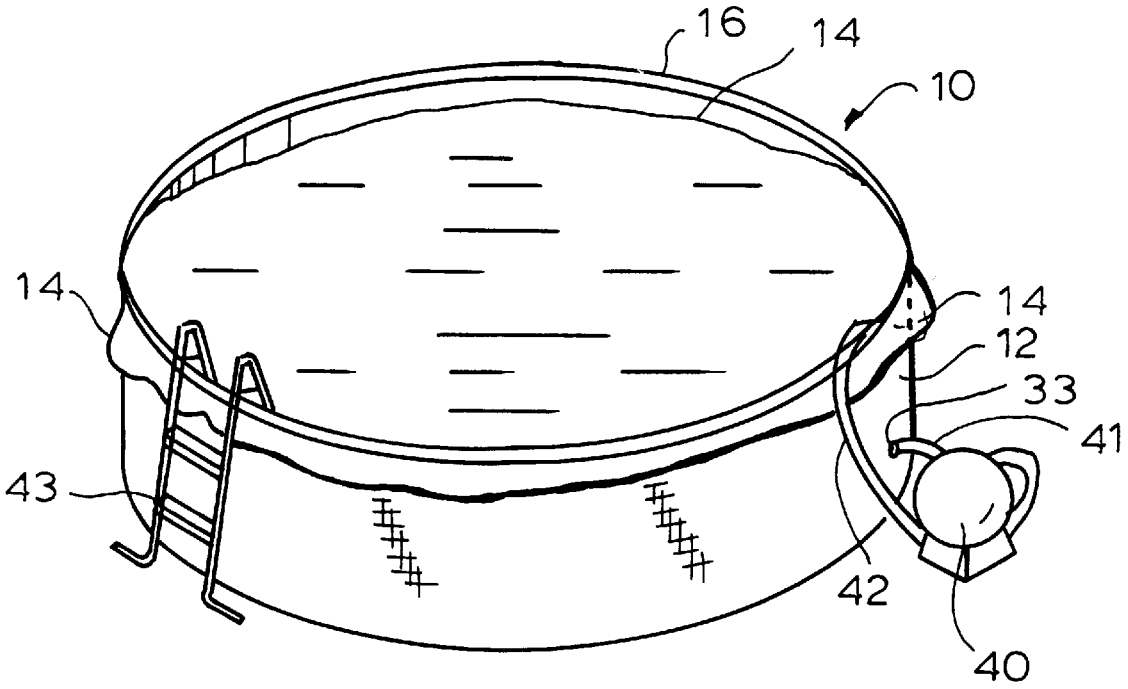
FIG. 1 is a perspective view showing an above-ground pool in accordance with the principles of the present invention.

Referring to the drawing and in particular to FIG. 1, reference character 10 represents the inventive circular, above-the-ground pool which is delimited by an upstanding vertical peripheral wall set up on the ground (preferably over a flat sand support surface) to form a cylindrical tank or shell 12. As is conventional in this type of pool, the pool shell 12 is lined with a water-retaining flexible liner 14 of polyvinyl chloride in the shape of a right cylinder.

A flexible U-shaped plastic coping 16 is used to secure the liner 14 to the upper edges of the shell wall 12 after it is draped in the shell. Thus after erection of the wall 12, as will be described hereinbelow, the liner 14 is draped within the periphery of the cylindrical pool wall 12 to establish a water-retaining structure.

Figure 2:
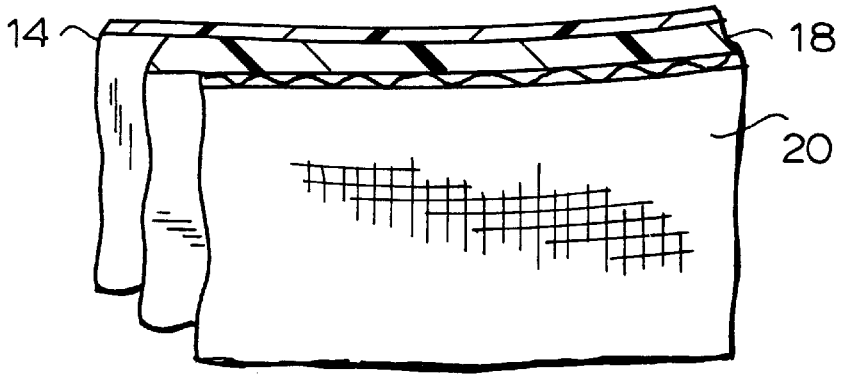
FIG. 2 is an enlarged fragmentary view showing the cross section of the new pool wall with a liner in place.

In accordance with the invention and as shown in FIG. 2, the new wall 12 is formed of a core of continuous length of semi-rigid, flexible high-melt strength polypropylene plastic 18 to which a woven mesh polypropylene fabric sheet structure 20 is laminated, preferably autogenously under heat and pressure. The sheet structure 20 is advantageously woven having a density of about 3 ounces per yard, a mesh of 24×11, and containing a UV inhibitor.

More specifically, the characteristics of a preferred mesh reinforcement sheet 20 are:

| Typical Properties | Test Method | |
|---|---|---|
| Material | | Polypropylene |
| Color | | Natural |
| Construction | ASTM D-3775 | 24 × 11 |
| Weight, oz/yd | ASTM D-3776-C | 3.0 |
| Tensile Strength | ASTM D-1682-GE | |
| warp, lbs. | | 150 |
| fill, lbs. | | 80 |
| Burst Strength, PSI | ASTM D-3786 | 275 |
| UV Resistance: Strength Retention | ASTM D-4355 | N/A |

The characteristics of a preferred base polypropylene core are:

| Typical Resin Properties | High-Melt-Strength Polypropylene |
|---|---|
| Melt flow rate, dg/min | 0.4 |
| Density, g/cm$^3$ | 0.902 |
| Notched Izod impact strength at 23° C. ft-lbs/in. (J/m) | 3.0 (161) |
| Tensile strength at yield, psi (MPa) | 5,400 (37) |
| Elongation at yield, % | 12 |
| Flexural modulus, psi (MPa) | 240,000 (1,650) |
| Rockwell hardness, R Scale | 96 |
| Deflection temperature at 66 psi (455 k Pa), °F. (°C.) | 194 |
| Water absorption after 24 hrs. % | 0.02 |
| Environmental stress-cracking, hrs. | >1,000 |
| Coefficient of linear thermal expansion, cm/cm/°C. | |
| −30 to 0° C. | $7.1 \times 10^{-5}$ |
| 0 to 30° C. | $9.7 \times 10^{-5}$ |
| 30 to 60° C. | $11.0 \times 10^{-5}$ |

The cylindrical wall or shell 12 of the pool of FIG. 1 is formed from a 38 ft. by 3 ft. rectangular sheet 30 (FIG. 3) having a series of assembly holes 31, 32 formed at its opposite side edges. The sheet 30 is folded so that the ends overlap and the holes 31, 32 register (FIG. 4). A series of bolts 36 inserted through each of the registered holes (FIG. 5) and secured by nuts 37 to establish a collapsed, closed sidewall loop 12 which is then set up as a cylindrical side wall 12 (FIG. 1). This provides an approximately 12 ft. diameter pool which will hold approximately 2,500 gallons. The length of the wall 12 can be increased to 47 ft. to provide a 15 ft. diameter pool holding approximately 3,900 gallons or to 57 ft. to provide an 18 ft. diameter pool holding approximately 5,700 gallons.

The wall 12 is provided with an intake opening 33 associated with which are circulating fittings including a leaf strainer 44, intake fitting 45, gasket 46, and locking ring 47. Advantageously a protective strip of adhesive tape (duct tape) 48 is superimposed on the nuts and bolts to cover any rough edges.

The intake fitting 45 is passed through a hole (not shown) formed in the liner 14 in registry with the intake hole 33 in the pool wall 12.

As common in above-ground, lined pools, the pool water is circulated by a circulating pump-filter 40 having an inlet hose line 41 extending from the intake fitting 35 to the pump and having a return hose line 42 extending back into the pool as shown.

An inverted-U shaped ladder 43 may be included as part of a pool kit for facilitating entry and egress from the pool.

The commercial attractions of the inventive pool are: the provision of a stronger, safer wall wherein the failure of a few strands of woven material will allow small amounts of pool water to escape without catastrophically bursting and flooding the area; the provision of a lighter product since reinforcing the polypropylene wall with polypropylene fabric allows a reduction of about 30% of the pool weight as compared with solid prior art walls; the reduction in the cost of production of pools; and the increase in the facility with which the pool wall may be decorated.

The pool of the invention has been thoroughly tested under actual use conditions and has been found to be completely successful for the accomplishment of the above-stated objects of the present invention.

It is understood that persons skilled in the art to which this invention is directed will be able to obtain a clear understanding of the invention after considering the foregoing description in connection with the accompanying drawing.

Although the foregoing description has been given by way of one preferred embodiment, it will be understood by those skilled in the art that other forms of the invention falling within the ambit of the following claims is contemplated. Accordingly, reference should be made to the following claims in determining the full scope of the invention.

I claim:

1. An above-ground frameless swimming pool comprising:

(a) a self-standing flexible semi-rigid upstanding catastrophic failure proof cylindrical plastic wall;

(b) said wall being formed of polypropylene having laminated thereto a reinforcing woven mesh fabric of polypropylene, said laminated wall having a sufficient weight-to-strength ratio and semi-rigidity that the wall is self-supporting;

(c) a water-retaining right cylindrical liner disposed within and supported by said wall; and (d) a coping member disposed over the upper part of said wall to secure upper portions of said liner thereto.

2. The pool of claim 1, wherein (a) the reinforcing polypropylene mesh has the following properties:

| | | |
|---|---|---|
| Construction | ASTM D-3775 | 24 × 11 |
| Weight, oz/yd | ASTM D-3776-C | 3.0 |
| Tensile Strength | ASTM D-1682-GE | |
| warp, lbs. | | 150 |
| fill, lbs. | | 80 |
| Burst Strength, PSI | ASTM D-3786 | 275 |

3. The pool of claim 1, wherein said polypropylene wall is approximately 0.075 inches in thickness, approximately 38–57 feet in length, and approximately 3 feet in width.

4. The pool of claim 1, in which (a) said reinforcing mesh is fabricated with fibers of contrasting colors in a predetermined pattern.

5. An above-ground pool comprising:

(a) a flexible semi-rigid upstanding cylindrical plastic wall;

(b) said wall being formed of plastic sheet material having laminated thereto a reinforcing woven mesh fabric, said laminated wall having a sufficient weight-to-strength ratio and semi-rigidity that the wall is self-supporting;

(c) a water-retaining right cylindrical liner disposed within and supported by said wall; and (d) a coping member disposed over the upper part of said wall to secure upper portions of said liner thereto.

* * * * *